United States Patent [19]

Demeter

[11] 4,010,334

[45] Mar. 1, 1977

[54] MOVING MAGNET CONTACT ACOUSTIC TRANSDUCER

[76] Inventor: James K. Demeter, 8542 Penfield, Canoga Park, Calif. 91306

[22] Filed: Jan. 27, 1975

[21] Appl. No.: 544,407

[52] U.S. Cl. ..... 179/114 M; 179/121 C

[51] Int. Cl.[2] ..... H04R 1/46; H04R 10/04

[58] Field of Search ..... 179/114 R, 114 A, 115 R, 179/115 A, 115.5 R, 115.5 E, 117, 120, 181 R, 114 M, 181 F, 181 W; 335/100.41 M, 231; 181/157, 170, 172

[56] References Cited

UNITED STATES PATENTS

| | | | |
|---|---|---|---|
| 370,477 | 9/1887 | Hayes | 179/117 |
| 1,401,143 | 12/1921 | Delany | 181/170 |
| 3,018,465 | 1/1962 | Harris | 340/8 |
| 3,033,945 | 5/1962 | Villchur | 179/180 |
| 3,076,520 | 2/1963 | Farwell | 179/181 R |
| 3,114,429 | 12/1963 | Miner | 179/181 R |
| 3,293,378 | 12/1966 | Heppner | 179/180 |
| 3,340,604 | 9/1967 | Parain | 179/115.5 R |
| 3,718,779 | 2/1973 | Schoengold | 179/115.5 R |
| 3,767,004 | 10/1973 | Liebscher | 181/172 |

FOREIGN PATENTS OR APPLICATIONS

| | | | |
|---|---|---|---|
| 937,420 | 8/1948 | France | 179/121 D |

*Primary Examiner*—George G. Stellar
*Attorney, Agent, or Firm*—Paul A. Weilein

[57] ABSTRACT

A dynamic acoustic transducer device of small, compact, highly efficient design, wherein a vibratable diaphragm is supported in an open side of a casing, a pair of permanent magnets being secured to the diaphragm for vibrational movement therewith, the magnets extending into the casing and being respectively surrounded by an electric coil winding which is isolated against vibrations of the diaphragm, the coils being connectable with a signal circuit. When the dynamic transducer comprises a microphone, the device is susceptible of mounting in an operating position by adhesively securing the outer surface of the diaphragm to a vibratable surface of a musical instrument, or other vibratable medium so that the relative movements between the magnets and coils in response to the sensed vibrations will function to produce a modulated output signal capable of being amplified and coupled to a loudspeaker. When the transducer is embodied in a device for the generation of sound waves, for example, in a loudspeaker system, a modulated electric signal is utilized to energize the coils and by interaction with the magnets to drive the diaphragm.

13 Claims, 3 Drawing Figures

MOVING MAGNET CONTACT ACOUSTIC TRANSDUCER

PRIOR ART

In the prior art there are numerous transducer devices which make use of the relative movement between a permanent magnet and a surrounding electric coil winding in a variety of magnetic pickup devices and loudspeaker arrangements. The closest art known to applicant are the following patents:

| | | |
|---|---|---|
| Lover | 2,896,491 | July 28, 1959 |
| Baermann | 2,951,190 | Aug. 30, 1960 |
| Fender | 3,147,332 | Sept. 1, 1964 |
| Broussard | 3,668,295 | June 6, 1972 |
| Parker | 3,798,391 | Mar. 19, 1974 |

BACKGROUND OF THE INVENTION

The present invention relates generally to transducer devices of the dynamic type, such as speakers and microphones, which utilize a relatively movable permanent magnet and an associated electric coil winding.

Heretofore, well known types of transducers in the form of microphones have in general comprised one of the following types:

a. A ceramic microphone in which a ceramic wafer produces an output current in response to received vibrations. This is considered to be a superior type and is relatively the most expensive, and requires a pre-amplifier in its use.

b. Moving coil type in which a coil is carried by a diaphragm and moved in response to picked up vibrations with respect to a fixed magnet. This type is considered as the next best type and is less expensive than the ceramic type.

c. The fixed coil type in which the coil surrounds a core magnet having a tin disc diaphragm supported at one end thereof, vibrations of the diaphragm serving to vary the reluctance of the magnetic circuit threading the coil turns. This is considered the poorest and least expensive of the microphone types.

The present invention comprises an improvement over the above enumerated types in that it incorporates a relatively simple but highly efficient transducer structure of the dynamic type, which embodies a vibratable diaphragm that can be attached in contact with a surface of a vibratable body, and more particularly with a resonator surface of a musical instrument such as, for example, a guitar, base viol, cello, banjo and the like, the diaphragm supporting a permanent magnet which is surrounded by an electric coil winding, the magnet and coil being relatively movable. It is a primary feature of the present invention that the coil is isolated with respect to vibrations of the diaphragm, so that the generated signals will be substantially free of distortions.

SUMMARY OF THE INVENTION

The present invention in general relates to transducers of the dynamic type, and is more particularly concerned with a unique and simplified arrangement which will permit the device to be mounted as a unit on a vibratable surface, and the provision of means for eliminating distortions and for controlling and damping the vibrations of the diaphragm.

One object of the herein described invention is to provide an improved transducer of the dynamic type, which is of simplified construction, efficient in operation, relatively free of distortions, and which can be economically produced and sold for a relatively reasonable price.

It is a further object to provide a transducer, according to the foregoing object, having relatively movable permanent magnet and associated electric coil winding elements, one of the elements being supported on and movable with a vibratable diaphragm, and the other element being fixedly mounted and insulated with respect to the vibration of the diaphragm.

A further object is to provide an improved transducer device of the dynamic type which is in the form of a self-contained compact unit having a diaphragm, and which can be mounted and retained in an operative position of use by adhesively securing the diaphragm to the surface of a vibratable body.

Another object is to provide an improved transducer device of the dynamic type which incorporates unique control means for damping the diaphragm vibrations.

Still another object is to provide in a dynamic transducer in which an electric coil winding surrounds an axially movable magnet, the improvement which includes means for guidingly maintaining the axial alignment of the magnet within the coil winding.

Yet another object is to provide an improved diaphragm of laminated form wherein a metal strip is sandwiched between outer layers of insulating material, and in which two magnets are secured at one of their ends to the diaphragm, and the metal strip forms a keeper for the magnets.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENT

Figure 1:
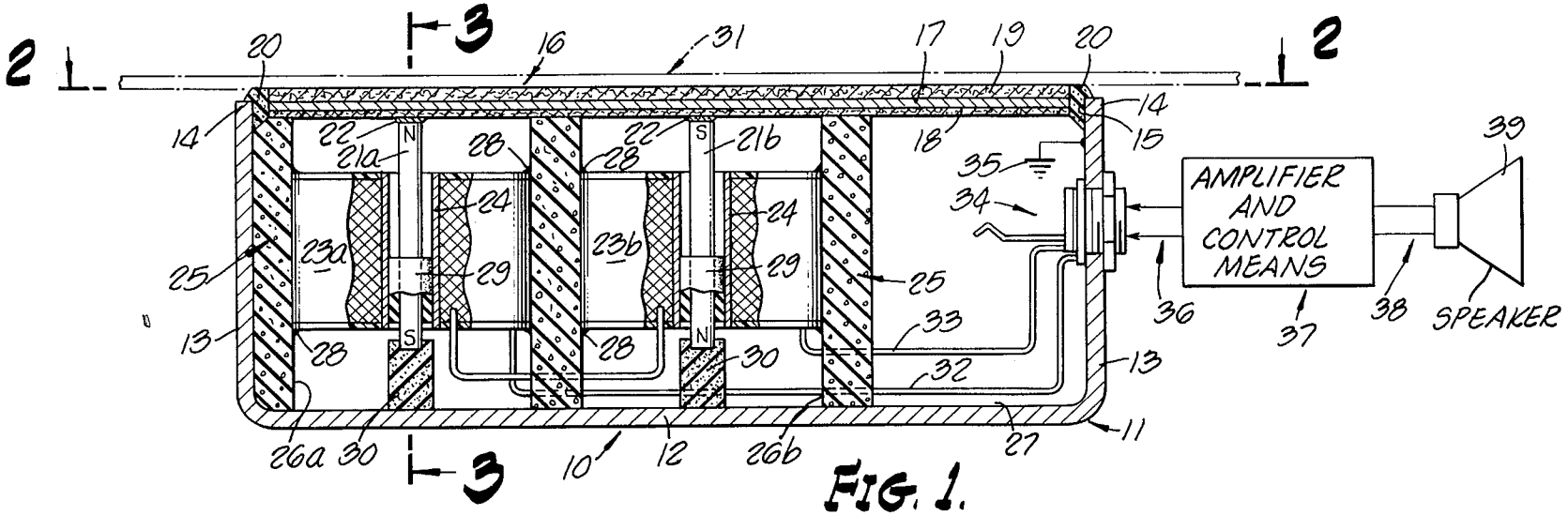
FIG. 1 is a vertical elevational sectional view of a transducer device embodying the features of the herein described invention, and diagrammatically illustrating the manner in which it is attached to the surface of a vibratable body.
Figure 2:
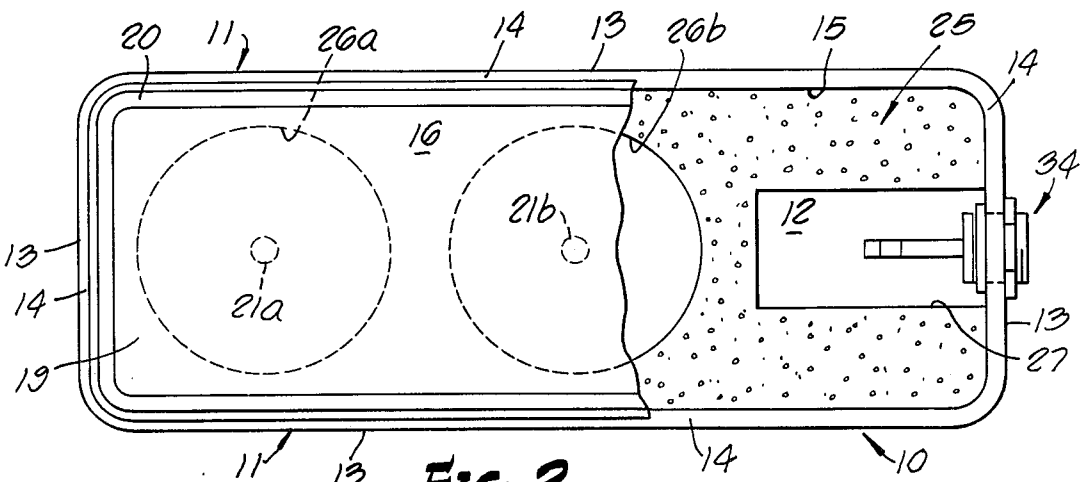
FIG. 2 is a plan view as seen substantially along line 2—2 of FIG. 1, portions being broken away to disclose the relative arrangement of certain internal parts.
Figure 3:
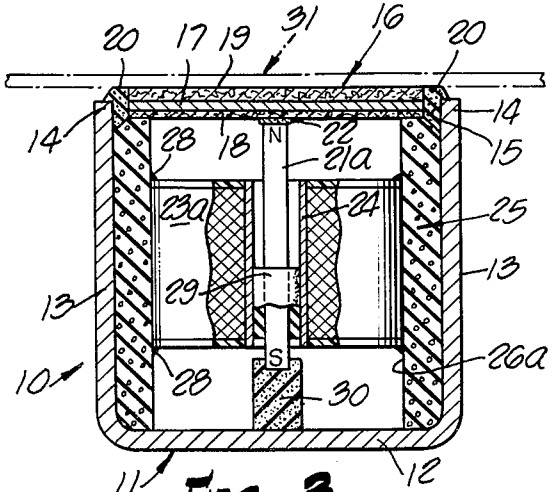
FIG. 3 is a transverse section taken substantially on line 3—3 of FIG. 1.

Referring more specifically to the drawings, for illustrative purposes, the invention is shown and will be described as being embodied in a microphone, although it is to be understood that the invention may also be used in a device for the generation of sound vibrations in a loudspeaker system.

More specifically, the invention is shown as being embodied in a small compact unit assembly, as generally indicated by the numeral 10. The unit is housed within a hollow casing 11 of suitable material, but preferably of metal, which is formed to provide a bottom 12 and an integrally formed upstanding peripheral wall 13 having an upper edge margin 14 which surrounds a generally rectangular side opening 15 of the casing.

The open side of the casing is closed by an acoustic diaphragm structure, as generally indicated by the numeral 16. This diaphragm is of laminated form and comprises an inner metallic strip 17 of a suitable metal which will not become permanently magnetized. One suitable metal for this purpose is commercially designated as "ferrous metal 10-10 alloy." The metallic strip 17 is sandwiched between an inner strip 18 and outer strip 19, which are of a paper-like material and may comprise a very rigid insulating paper commercially known as "fish paper." The strips 17, 18 and 19 have substantially coextensive surface areas of engagement and provide a rigid diaphragm structure. This diaphragm is supported for vibratory movements at its periphery by means of a suitable elastic bond 20 of a silicon rubber material which seals the diaphragm in the side opening 15 of the casing and also isolates the casing 11 with respect to vibrational movements of the diaphragm. The paper strips 18 and 19 serve to prevent resonant vibration of the metal strip 17, while the metal strip 17 serves as a keeper for a pair of elongate permanent magnet elements 21a and 21b, which are positioned in spaced apart parallel relationship and have their uppermost ends glued as indicated at 22 to the inner surface of the diaphragm. As thus mounted, the metal strip 17 functions to increase the area of the magnetic field and thus increases the output voltage gain of the device.

The magnet elements are positioned so that their connected ends will have unlike polarity. As shown, the magnet 21a has its north pole end connected to the diaphragm, while the magnet 21b has its south pole end connected to the diaphragm. These magnets are respectively operatively associated with surrounding electric coil windings **23*a* and 23*b*, which are respectively wound on a brass or plastic tubular core 24** that can be internally finished to provide a close tolerance. As will be noted, each of the permanent magnets is of sufficient length so that its lowermost end projects below its associated coil winding.

The coil windings **23*a* and 23*b* are maintained in a midposition between the diaphragm and the bottom 12 of the casing by means of a filler member 25 of foam rubber insulation or other suitable material which is fabricated to provide spaced parallel cylindrical openings 26*a* and 26*b*, and a generally rectangular opening 27** at one end of the member.

The openings **26*a* and 26*b* are so located and of a size to snugly receive and support the respective coil windings 23*a* and 23*b* therein so as to coaxially surround the associated permanent magnet elements. The respective coil windings are secured in operative position in the openings by peripheral top and bottom bonding or gluing as indicated at 28. In supporting the coils in this manner on the filler member 25, this filler member further contributes to the isolation of the coils 23*a* and 23*b* with respect to the vibrations of the diaphragm, and in this manner substantially eliminates any distortion in the output signal which might be produced by the transmission of diaphragm vibrations through the casing 11** to the coil windings.

The lowermost end portions of the permanent magnets are respectively guidingly positioned within the tubular cores 24 and maintained in axial alignment with the coil elements by means of a surrounding tubular sleeve 29 having a close sliding fit within the associated tubular core 24. This sleeve may be constructed of silicon rubber or other suitable material, and may be molded or otherwise secured to the magnet. This sleeve also serves to prevent distortions in the generated signals.

A further feature of the present invention resides in the provision of means to control and provide a damping effect with respect to the vibratory motions of the magnets. For this purpose, a post 30 of a suitable material such as sponge rubber is secured to the bottom 12 of the casing in axial alignment with each of the permanent magnets in such a manner that the lowermost ends of the magnets will be seated under pressure in the upper ends of the posts so as to compress the material in the post and thus provide a damping effect with respect to the motion of the magnets. By controlling the amount of applied pressure, the damping may be variably controlled, as desired. When utilizing the post 30, it will be appreciated that these posts will also serve to guidingly position the lowermost ends of the magnets with respect to the core axis of the associated core windings, and under such conditions the guide sleeves 29 may in some cases be omitted.

When utilizing the device as a microphone to pick up vibrations, the exposed surface of the diaphragm structure 16 will be adhesively secured to an exposed surface of a vibratable member, as indicated in phantom lines by the numeral 31, and which may comprise the resonant body of a musical instrument or other vibratable body. These vibrations are transmitted to the permanent magnets which coact with the fixed coil windings to generate a signal. The windings of the electric coils are in reversed phase relation, and the coils are connected in series with terminal conductors 32 and 33 leading to an appropriate plug receiving receptacle 34, one terminal of this receptacle being electrically connected with the casing 11 which is grounded as indicated at 35. The receptacle 34 permits ease of connection of the device by means of a suitable plug connector, not shown, with an appropriate signal circuit 36 leading to the input of suitable amplifier and control means, as diagrammatically indicated at 37, having an output circuit 38 which is connected with a loudspeaker 39. Within the casing 11, the plug receiving receptacle 34 is positioned within the opening 27 of the filler member 25.

From the foregoing description and drawings, it will be clearly evident that the delineated objects and features of the invention will be accomplished.

Various modifications may suggest themselves to those skilled in the art without departing from the spirit of my invention and, hence, I do not wish to be restricted to the specific forms shown or uses mentioned, except to the extent indicated in the appended claims.

I claim:

1. A dynamic acoustic transducer device, comprising:

a. a rigid body defining a support;

b. an elongated permanent magnet element;

c. an electric coil element surrounding said magnet and having terminals for connection to a signal circuit, said magnet having pole ends axially projecting beyond the ends of said coil;

d. a flat rigid diaphragm having its periphery elastically connected to said support;

e. said permanent magnet element being wholly positioned on one side of said diaphragm and being attached thereto for vibrational axial movements therewith; and f. elastic means supporting said electric coil on said support and constituting means resiliently isolating said coil from vibrational movements of said diaphragm.

2. A device according to claim 1, wherein said support is a hollow casing said electric coil being supported within said casing by a member fabricated from foam rubber.

3. A device according to claim 2, wherein said foam rubber member comprises an insert having a cylindrical opening in which said coil element is coaxially supported in a position spaced between said diaphragm and the bottom of said casing.

4. A device according to claim 1, wherein said diaphragm has an outer flat surface adapted for face securement to a vibration transmitting medium for direct mechanical vibration thereby.

5. A device according to claim 4, in which said diaphragm has an inner surface rigidly connected to said one of said elements.

6. A device according to claim 1, wherein the diaphragm comprises a laminated structure with flat strips having substantially coextensive surface areas of engagement.

7. A device according to claim 6 in which said laminated structure is composed of a metallic strip sandwiched between outer and inner strips of a paper-like material.

8. A device according to claim 1, wherein one end of said magnet is attached to said diaphragm; and including means carried by the other end of said magnet for guidingly maintaining the axial position of the magnet within said coil.

9. A device according to claim 8, wherein the guiding means comprises a tubular sleeve of molded resilient material.

10. A device according to claim 9, wherein the sleeve is of a silicon rubber material.

11. A device according to claim 8, in which the coil element is supported within a surrounding casing; and said guiding means comprises a post of elastic material secured to an adjacent wall of said casing, and with said other end of the magnet seated therein.

12. A device according to claim 11, wherein said post is of a sponge rubber material, and is under compression, whereby to provide a controlled damping effect for vibrational movements of said magnet.

13. A dynamic acoustic transducer device, comprising:

a. a hollow casing having an open side;

b. a vibratable diaphragm supported in the open side of said casing, said diaphragm including an elongated metallic strip;

c. a pair of elongate permanent magnets secured at one end to said diaphragm in spaced relation and projecting at a right angle thereto into said casing, the connected ends of said magnets being of unlike polarity, and the metallic strip of said diaphragm providing a keeper for said magnets;

d. a pair of electric coil windings in said casing respectively surrounding said magnets and being adapted for coupling with a signal circuit, said coil windings being connected in series and having their windings in reversed phase relation; and e. means for supporting and isolating said coil windings with respect to vibrations of said diaphragm.

* * * * *

UNITED STATES PATENT OFFICE

CERTIFICATE OF CORRECTION

PATENT NO. : 4,010,334

DATED : March 1, 1977

INVENTOR(S) : JAMES K. DEMETER

It is certified that error appears in the above-identified patent and that said Letters Patent are hereby corrected as shown below:

Claim 5, line 3, "one of said elements" should read --permanent magnet element--.

Signed and Sealed this

Third Day of May 1977

[SEAL]

*Attest:*

RUTH C. MASON
*Attesting Officer*

C. MARSHALL DANN
*Commissioner of Patents and Trademarks*